US006612238B2

(12) United States Patent
Voge et al.

(10) Patent No.: US 6,612,238 B2
(45) Date of Patent: Sep. 2, 2003

(54) INKING UNIT IN A PRINTING MACHINE

(75) Inventors: Michael Voge, Malsch (DE); Bernhard Roskosch, Wiesloch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/843,467

(22) Filed: Apr. 26, 2001

(65) Prior Publication Data

US 2002/0002919 A1 Jan. 10, 2002

(30) Foreign Application Priority Data

Apr. 26, 2000 (DE) ..... 100 20 318
Jan. 30, 2001 (DE) ..... 101 03 842

(51) Int. Cl.[7] ..... B41F 31/02
(52) U.S. Cl. ..... 101/365; 101/367; 118/261
(58) Field of Search ..... 101/365, 169, 101/363, 367; 118/261

(56) References Cited

U.S. PATENT DOCUMENTS 4,242,958 A * 1/1981 Jeschke ..... 101/363
4,406,224 A * 9/1983 Hajek ..... 101/363
4,495,864 A 1/1985 Junghans ..... 101/365
4,960,052 A 10/1990 Junghans ..... 101/350
4,969,395 A * 11/1990 Mitamura et al. ..... 101/365
5,009,159 A * 4/1991 Stenqvist ..... 101/169
5,383,395 A * 1/1995 Buschulte ..... 101/365
5,483,885 A * 1/1996 Leineweber ..... 101/120
5,662,043 A * 9/1997 Fischer et al. ..... 101/365
5,694,851 A * 12/1997 Bruni ..... 101/365
5,727,463 A * 3/1998 Deschner et al. ..... 101/365
5,778,785 A * 7/1998 Blackwell ..... 101/365
5,857,412 A * 1/1999 Roskosch et al. ..... 101/365
5,960,715 A * 10/1999 Voge et al. ..... 101/365
6,349,645 B1 * 2/2002 Roskosch ..... 101/364
6,378,428 B1 * 4/2002 Schonberger ..... 101/350.1

FOREIGN PATENT DOCUMENTS

DE 32 03 500 C3 8/1983
DE 38 04 204 C2 8/1989
DE 43 00 071 A1 7/1994
DE 199 14 179 A1 11/1999
DE 199 17 927 A1 11/1999
DE 199 28 880 A1 1/2000
GB 2 273 910 A 7/1994

* cited by examiner

*Primary Examiner*—Stephen R. Funk
*Assistant Examiner*—Dave A. Ghatt
(74) *Attorney, Agent, or Firm*—Laurence A. Greenberg; Werner H. Stemer; Ralph E. Locher

(57) ABSTRACT

An inking unit in a printing machine, formed as a film inking unit, includes an ink duct with an ink duct film inserted between an ink metering system, which is subdivided into ink zones, and an ink duct roller. The ink duct film within each of the ink zones in a region of a settable metering gap is held out of contact with the ink duct roller during printing. The invention also includes a printing machine, such as a sheet-fed printing machine, particularly, provided with the inking unit.

12 Claims, 3 Drawing Sheets

INKING UNIT IN A PRINTING MACHINE

BACKGROUND OF THE INVENTION

Field of the Invention

The invention relates to an inking unit in a printing machine, the inking unit being embodied as vibrator-less continuous-type inking unit and having an ink duct or fountain with an ink duct film inserted between an ink metering system, which is subdivided into ink zones, and an ink duct roller.

In the published German Patent Document DE 199 14 179 A1, an ink duct of this type has been described having an ink duct film which is pressed against an ink duct roller by support struts of metering elements of the ink metering system; consequently, the ink duct film is subjected to high mechanical stress. In order nevertheless to assure a long service life of the ink duct film, the latter ink fountain film is provided with low-wear zones formed as wirelike bodies. Although abrasion of the low-wear zones is less than for zones of high wear, nevertheless, the production costs for such an ink duct film are comparatively high. It would be desirable, instead of this complicated, expensive ink duct film, to be able to use a simpler, less expensive ink duct film formed as a disposable item. Each time residual ink remains in the ink duct, and the ink duct film is replaced by another printing ink to be used for a subsequent printing job, it is convenient to throw the ink duct film away and insert a fresh ink duct film into the ink duct. Considering how often ink changes must be made, however, this is feasible only if inexpensive ink duct films can be used.

Furthermore, the published German Patent Document DE 38 04 204 C2 describes a continuous-type inking unit which has an ink duct roller disposed in an ink duct that is equipped with a zonewise regulatable metering system. An unfavorable aspect of this continuous-type inking unit is that cleaning it is tedious; all the residual ink in the ink duct must be removed therefrom with time-consuming labor, using a spatula and cloths. The continuous-type inking unit is therefore suitable only for a roller-type printing press as shown in the last-mentioned German patent document, wherein the interval between cleanings of the ink duct is quite long, because ink is changed only seldom in roller-type printing presses.

Also representing a further state of the art is a vibrator-type inking unit of a sheet-fed printing machine, which is described in the published German Patent Document DE 32 03 500 C3; this inking unit has an ink duct with an ink duct film and an ink duct blade or knife that is subdivided into tongues with scraper edges, for zonal ink metering. Relative to the jacket surface of the ink duct roller, each of the tongues can be set to an open metering gap corresponding to the ink demand in the respective ink zone, and in ink zones not requiring ink, each tongue can be set to a uniform basic position, i.e., a closed zero position. Each tongue set to the basic position presses the ink duct film against the ink duct roller with an initial tension or pretensioning. The pretensioning is due to the assembly operation, wherein each scraper edge, without the ink duct film being in place, is adjusted to a precise amount relative to the jacket surface of the ink duct roller, this amount being equivalent to approximately 50% of the film thickness. In addition, the ink duct film has a smooth and hard surface. Although wear of the ink duct film caused by abrasion by the ink duct roller in the printing operation can possibly be reduced slightly by suitable adjustment of the uniform basic position and by the development of the film surface, nevertheless, the wear cannot be sufficiently prevented in the manner described. The incident wear is admittedly compensated for somewhat by the elasticity of the ink duct film, but the resultant change in the pretensioning causes metering imprecisions because, as the initial tension or pretension lessens because of the pressure head or dynamic pressure of the ink inside an ink zone that intrinsically is kept closed, ink is nevertheless fed between the ink duct roller and the ink duct film and out of the ink duct.

SUMMARY OF THE INVENTION

It is accordingly an object of the invention, therefore, to provide an inking unit of the type described at the introduction hereto, which allows simpler, less expensive ink duct films to be used.

With the foregoing and other objects in view, there is provided, in accordance with one aspect of the invention, in a printing machine, an inking unit formed as a vibrator-less continuous-type inking unit, comprising an ink duct with an ink duct film inserted between an ink metering system, which is subdivided into ink zones, and an ink duct roller, the ink duct film within each of the ink zones in a region of a settable metering gap being held out of contact with the ink duct roller during printing.

In accordance with another feature of the invention, the inking unit includes a film roller, the ink duct roller and the film roller together defining a film nip therebetween, the width of which remains constant during printing.

In accordance with a further feature of the invention, the ink duct film rests on a base of the ink duct, and the base covers the ink metering system.

In accordance with an added feature of the invention, a central angle of the ink duct roller, the angle being defined by the film nip and by the metering gap between the ink duct film and the ink duct roller, is of 70° to 110°.

In accordance with an additional feature of the invention, t according to claim 2, wherein a central angle of the film roller, the angle being defined by the film nip and by a printing nip between the film roller and an ink roller resting thereon, is of 70° to 110°.

In accordance with yet another feature of the invention, the ink metering system is supported on a bearing bushing of the ink duct roller via an adjusting device.

In accordance with yet a further feature of the invention, the adjusting device rests on a part of the bearing bushing protruding from a frame.

In accordance with yet an added feature of the invention, the adjusting device comprises a threaded pin and a lock nut.

In accordance with yet an additional feature of the invention, respective widths of the ink zones are determined by metering elements of the ink metering system.

In accordance with another aspect of the invention, there is provided a printing machine having an inking unit formed as a vibrator-less continuous-type inking unit, comprising an ink duct with an ink duct film inserted between an ink metering system, which is subdivided into ink zones, and an ink duct roller, the ink duct film within each of the ink zones in a region of a settable metering gap being held out of contact with the ink duct roller during printing.

In accordance with a concomitant aspect of the invention, there is provided a sheet-fed printing machine having an inking unit formed as a vibrator-less continuous-type inking unit, comprising an ink duct with an ink duct film inserted between an ink metering system, which is subdivided into ink zones, and an ink duct roller, the ink duct film within each of the ink zones in a region of a settable metering gap being held out of contact with the ink duct roller during printing.

The inking unit according to the invention, in a printing machine, requires that, during printing, the ink duct film inside of each of the ink zones in the region of a settable metering gap be kept out of contact with the ink duct roller.

A decisive advantage of the inking unit of the invention is that without sacrifices in terms of the metering stability, it allows the use of a simple, inexpensive ink duct film, which is no longer exposed at all to what in the prior art, namely, the published German Patent Document DE 199 14 179 A1, is merely reduced abrasion wear. The residual ink present in the ink duct after a printing job can to a great extent be removed from the ink duct along with the ink duct film. Thereafter, only very quickly performed fine cleaning of the ink duct and the insertion of a clean, new ink duct film into the ink duct are required before the ink to be used for the next printing job is introduced into the ink duct.

Another advantage of the inking unit of the invention is the excellent suitability thereof for use in a sheet-fed printing press. Typical printing jobs for sheet-fed printing presses generally involve a low number of copies and correspondingly a short execution time. Furthermore, these printing jobs often require a change of ink from one printing job to another, for example, because different special or customer-specific inks must be used for each printing job. Consequently, the ink duct of the sheet-fed printing press must be cleaned quite often, and these cleaning operations can be performed without major effort and quickly by the ink duct film of the inking unit according to the invention when it is used in a sheet-fed printing machine.

Yet another advantage of the inking unit of the invention is the very high metering stability and metering precision thereof. Embodying the inking unit as a vibrator-less continuous-type inking unit makes it possible to keep the ink duct film, during printing, in the region located between an ink duct roller and an ink metering system, without any contact at all with the ink duct roller associated with the ink duct, over all the ink zones of the inking unit. During the printing operation, no single ink zone of an ink metering system associated with the ink duct thus has to be closed completely, and so that even inside every ink zone that does not require ink, over the full width of the respective ink zone, only a tiny, pressure-free gap is present between the ink duct film and the ink duct roller. Although, in the ink zone that does not require ink, the ink from the ink duct roller is fed out of the ink duct through the tiny gap, nevertheless a film roller associated with the ink duct roller picks up the ink from the ink duct roller only in ink zones that do require ink, but not in the ink zone which does not require ink. The size of the tiny gap in each ink zone not requiring ink is approximately equivalent to the size of a film gap that the ink duct roller forms together with the film roller. In each ink zone that does require ink, the enlargement of the tiny gap, corresponding to the respective ink demand, produces a metering gap. The thickness which is determined by the size of the metering gap, of an ink film fed out of the ink duct by the ink duct roller is so great that the film roller picks up some of this ink film.

Structurally and functionally advantageous refinements of the inking unit according to the invention are recited in the dependent claims and will become apparent from the ensuing description of an exemplary embodiment and the associated drawing.

Other features which are considered as characteristic for the invention are thus set forth in the appended claims.

Although the invention is illustrated and described herein as embodied in an inking unit in a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
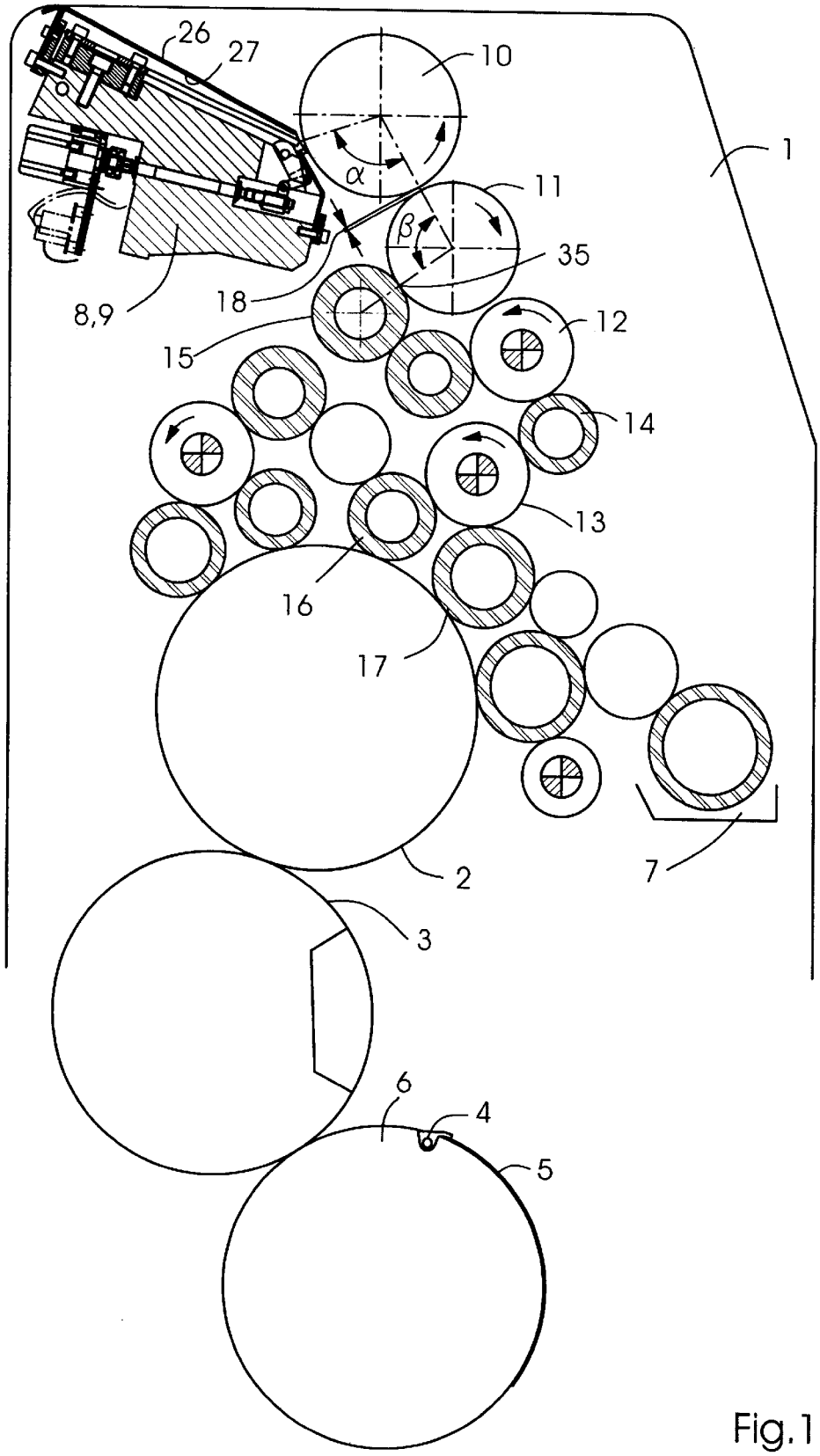
FIG. 1 is a fragmentary diagrammatic side elevational view, partly in section, of a printing machine with a vibrator-less continuous-type inking unit, which includes an ink duct, an ink duct roller, and a film roller.
Figure 2:
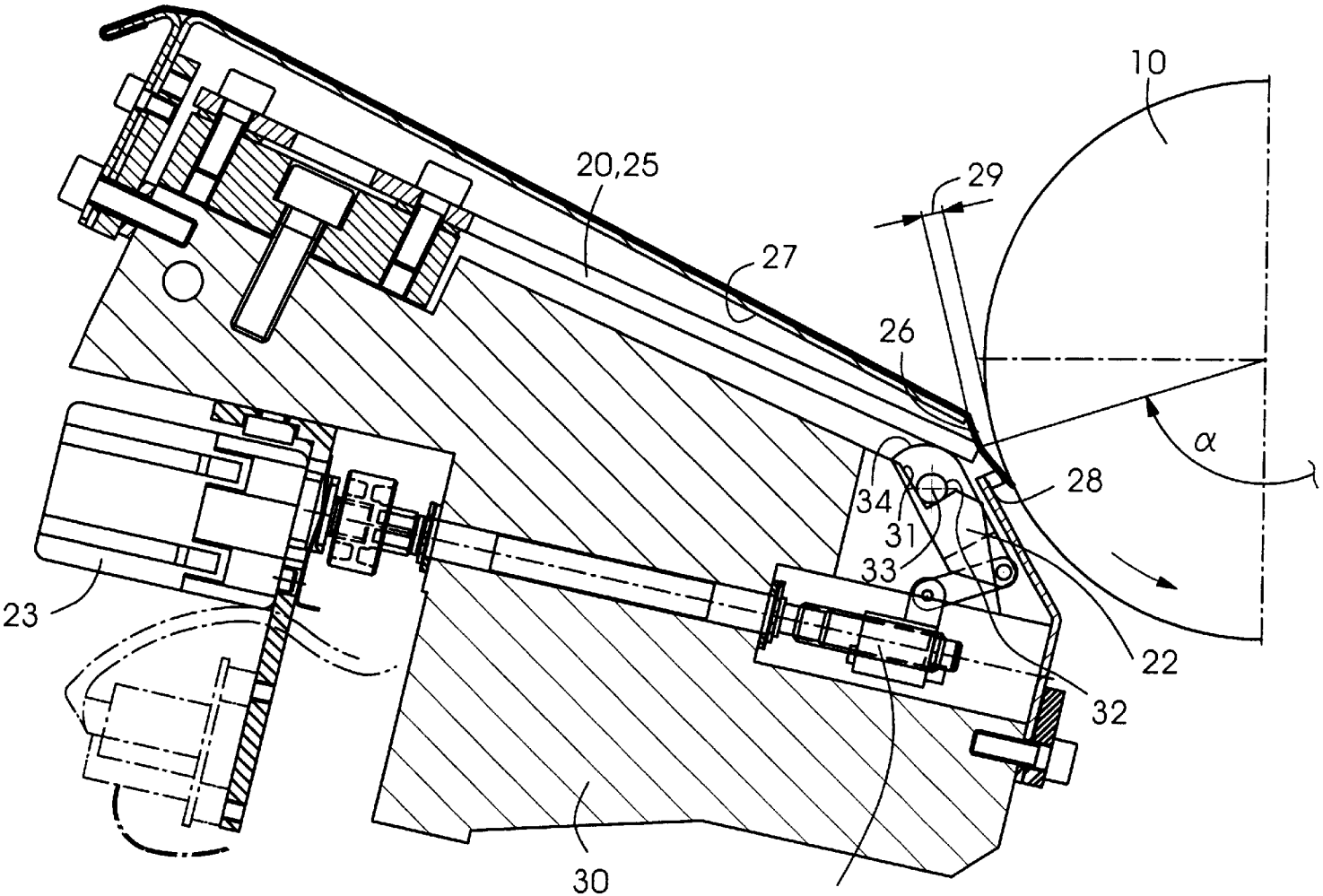
FIG. 2 is an enlarged fragmentary view of FIG. 1, showing the ink duct in section, with an ink duct film introduced therein, and with the ink duct roller.

Referring now to the drawings and, first, particularly to FIG. 1 thereof, there is shown therein a detail of a printing machine 1 embodied as a sheet-fed printing press. This detail shows an offset printing unit of the printing machine 1, which includes a printing form cylinder 2, a rubber blanket cylinder 3, and an impression cylinder 6 equipped with a row of grippers 4 for holding a sheet 5 of printing material. For dampening purposes, a dampening unit 7 and, for inking, an inking unit 8 are associated with the printing form cylinder 2.

The inking unit 8 is embodied as a vibrator-less continuous-type inking unit and includes a wedge-shaped ink duct 9, an ink duct roller 10 disposed close to an end thereof, a film roller 11, traversing friction rollers 12 and 13, ink rollers 14 and 15 functioning as transfer rollers and having a soft rubber coating on the circumference thereof, and applicator rollers 16 and 17 which roll along the printing form cylinder 2. The film roller 11 rotates at a circumferential surface speed that corresponds to the circumferential surface speed of the printing form cylinder 2, and the ink duct roller 10 rotates at a considerably lower circumferential surface speed than the film roller 11. Between a profiled circumferential surface of the film roller 11 and a smooth circumferential surface of the ink duct roller 10, a film gap or nip 18 is provided, which opens to a width of 0.01 mm to 0.10 mm, and preferably more than 0.05 mm.

A prerequisite for the dimensions given hereinabove for the film gap 18 is a measurement originating in raised structural elements (struts) of a multiple-thread circumferential surface structure 19 of the film roller 11, the surface structure being wound helically with a high pitch (note FIG. 3). In regions of indented structural elements (grooves) formed in the circumferential surface structure 19, the film gap 18 reaches slightly wider values than the dimensional indications made hereinabove. The circumferential surface structure 19 is advantageous with regard to "milling or shearing off" a zonally differently thickly metered ink film on the ink duct roller 10 by the film roller 11.

To establish a zonally variable ink profile of the ink film located on the ink duct roller 10, in the various ink zones over the width of the printing, the ink duct 9 forms a structural unit together with an ink metering system 20. The ink metering system 20 includes a plurality of tongue like metering elements 24 and 25 (note FIG. 3), each of which controls the ink flow out of the ink duct 9 in the region of a respective ink zone, and all of which are assembled close together side by side to form an ink meter. Each of the metering elements 24 and 25 is displaceable individually by an electric control motor 23 towards and away from the ink duct roller 10 via a helical gear 21 and an adjusting cam 22, pivotably connected thereto. Depending upon how far the respective adjusting cam 22 is pivoted, the respective adjusting cam 22 presses more or less strongly against the underside of the metering element 24 or 25 near a stripper edge of the respective metering element 24 or 25, so that this element together with the ink duct roller 10 forms a gap or nip of greater or lesser width.

Between the stripper edge of the respective metering element 24 or 25 and the ink duct roller 10, an elastic ink duct film 26 formed of plastic material extends through the aforementioned gap; inside the ink duct 9, this film rests on a base or bottom 27 of the ink duct 9, the bottom 27 being disposed above and spaced apart from the metering elements 24 and 25, and outside the ink duct 9, the film is pressed lightly against the ink duct roller 10 by a soft contact-pressure strip 28 formed of sponge rubber. The bottom 27 extends in a flat, closed manner in the direction of the printing width across all the metering elements 24 and 25 and ink zones. Because the ink duct film 26 does not rest directly on the metering elements 24 and 25, large-area creasing of the ink duct film 26 upon displacement of one metering element 24 relative to the other metering element 25 located next to it is advantageously averted.

The size of the aforementioned gap or nip between the respective metering element 24 or 25 and the ink duct roller 10, less the thickness of the ink duct film 26, is the size of a metering gap or nip 29, through which the ink, which has accumulated on the ink duct film 26 in the ink duct 9, emerges from the ink duct 9. In the course of the printing operation, one such metering gap 29, which, depending upon the zonal ink demand, is open more or less widely as a result of a corresponding displacement of the metering element 24 or 25, is located in the region of each ink zone between the ink duct film 26 and the ink duct roller 10.

With a view to avoiding any abrasion of the ink duct film 26 caused by the rotating ink duct roller 10, it is advantageous that, during the printing operation, the ink duct film 26 does not come into contact the ink duct roller 10 inside any single metering gap 29 of the entire ink metering system 20, or in other words that each metering gap 29 of the ink metering system 20 is more or less open.

To enable the removal of most of the ink from the ink duct roller 10 after the termination of the printing operation and before washing the inking unit 8, provision can be made for all the metering elements 24 and 25 of the ink metering system 20 to be displaced towards the ink duct roller 10, so that, in all the ink zones, the ink duct film 26 presses uniformly against the ink duct roller 10, and the ink film located on the ink duct roller is, as a result, scraped off virtually completely. The metering elements 24 and 25 are displaced in this process towards the ink duct roller 10 past those positions that the metering elements 24 and 25 would assume during the printing operation at a setting corresponding to the ink zones thereof without a demand for ink. In the course of this scraping off of the rotating ink duct roller 10 before washing, any abrasion of the ink duct film 26 that occurs is no longer a problem and has no influence whatsoever on the metering precision of the ink metering system 20 in an ensuing printing job because, for the new printing job, a new ink duct film 26 is inserted into the ink duct 10 and is suspended by the bent-over rear or trailing edge thereof from a hooklike retainer disposed on the end of the ink duct 9 located opposite the ink duct roller 10. The old ink duct film 26 that becomes worn as the ink is scraped off can be removed from the ink duct 10 with the residual ink deposited thereon and then thrown away.

If, during a printing operation, the metering element 25, for example, is displaced to a setting corresponding to that for the ink zone without an ink demand, the ink duct roller 10 then, nevertheless, transports an ink film through the metering gap 29; the thickness of this film corresponds to the thickness of the metering gap 29 determined by the thus-set metering element 25. However, in the region of the ink zone without an ink demand, this ink film is not picked up from the ink duct roller 10 by the film roller 11, because the metering gap 29 and the thickness of the ribbonlike ink film created by the metering gap on the ink duct roller 10 is smaller, respectively, than the film gap or nip 18, the size of which can be set by an adjusting device associated with the film roller 8.

Each adjusting cam 22 of the ink metering system 20 has a prismatically profiled bearing shell 31, formed directly by a solid base body 30 of the ink duct 9, and a bearing pin 32, placed in the bearing shell 31, with a rotational axis 33 that is eccentrically offset from a central point of a circular-arclike rounded face 34 of the respective adjusting cam 22. Due to the support of the bearing pin 32 directly on the base body 30 without further intermediate parts, great stability of the ink metering system 20 is advantageously attained.

With a view to minimizing the influence, during the printing operation, of incident hydrodynamic forces in the film gap 18 on the size of the metering gap 29, it is advantageous that a central angle (note FIG. 1), which is referred to a pivot point of the ink duct roller 10 and follows the metering gap 29 in the direction of rotation of the ink duct roller 10, and which is located between the metering gap 29 and the film gap 18, is of 70° to 100° and preferably approximately 90°.

With a view to minimizing the influence, in the printing operation, in a printing nip 35 formed by the film roller 11 together with the ink roller 15, of incident hydrodynamic forces on the film gap 18, it is advantageous that a central angle, which is referred to the pivot point of the film roller 11 and follows the film gap 18 in the direction of rotation of the film roller 11, and which is located between the film gap 18 and the printing nip 35, is of 70° to 110°, and preferably approximately 90°.

Figure 3:
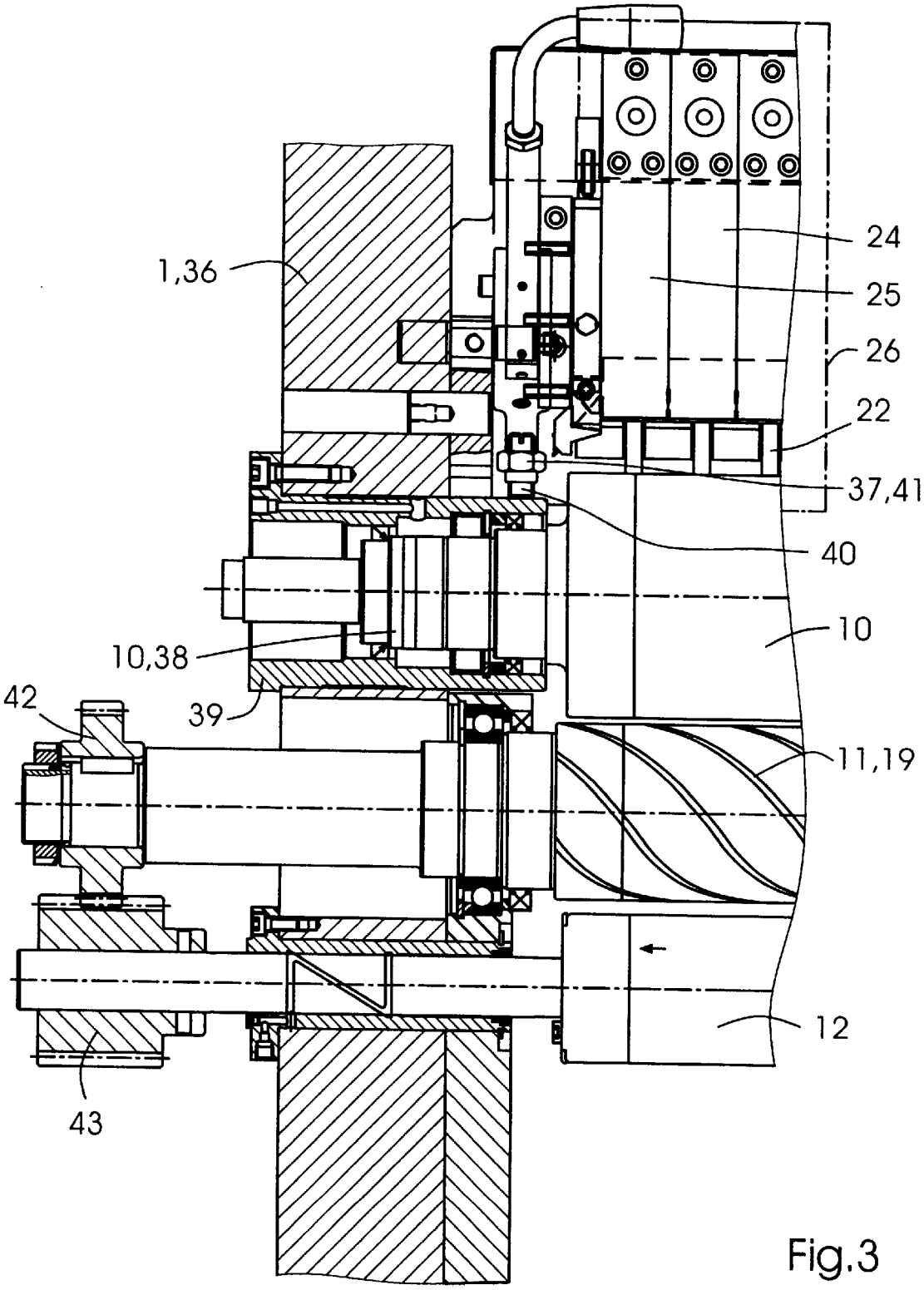
FIG. 3 is a fragmentary top plan view of the ink duct with the ink duct film removed therefrom, and also showing the ink duct roller and a film roller.

In FIG. 3, in the interest of greater clarity, the ink duct 9 is shown without the ink duct film 26 that normally lines the ink duct on the inside thereof, and without the bottom 27, so that the metering elements 24 and 25 can be seen quite readily.

The ink duct 9 assembled from the base body 30 and the ink metering system 20, can be pivoted away from the ink duct roller 10 for maintenance purposes and, for the purpose of printing, it can be pivoted back towards the ink duct roller 10 again, in each case being supported in a lateral frame 36 of the printing machine 1. To enable the orientation of the ink duct 9 in a zero position relative to the ink duct roller 10, the zero position being important with a view to metering precision, an adjusting device 37 is secured to the ink duct 9 at each end thereof; the adjusting device is supported on a bearing bushing 39 that is inserted into the frame 36 and surrounds a journal 38 of the ink duct roller 10. The adjusting device 37 is formed of a threaded pin 40, which is screwed into the ink duct 9, the position of the pin 40 adjusted relative to the ink duct 9 being secured by a lock nut 41 screwed onto the threaded pin, the lock nut 41 being seated with a crowned end face thereof on the outside of the bearing bushing 39 that is inserted into the frame 36, and forms a stop for the adjusting device 37. Due to the described supporting or bracing of the ink duct 10, the bending length of the ink duct 9 and the ink duct roller 10 which is effective under load is advantageously kept short. As is also apparent from FIG. 3, a gearwheel 42, connected coaxially and in a manner so as to be fixed against rotation relative to the film roller 11, the film roller 11 being rotatively driven via the gearwheel 42 electromotively and formlockingly, meshes with a gear wheel 43 by which the distributor roller 12 is rotatively driven electromotively and formlockingly. In this regard, it is noted that a formlocking connection is one which connects two elements together due to the shape of the elements themselves, as opposed to a forcelocking connection, which locks the elements together by force external to the elements. Between the circumferential surfaces of the rollers 11 and 12, which are drivingly coupled to one another via the gearwheels 42 and 43, there is a relatively greater spacing, which precludes a direct transfer of ink from the film roller 11 to the friction roller 12. The roller 12, with which the gearwheel 43 is connected coaxially and in a manner so as to be fixed against relative rotation, need not be a friction roller in every application.

Because of the ink film, which is applied to the ink duct roller 10 by the ink metering system 20 without creating ink-free rings (circumferential stripes) on the ink duct roller, and which is uninterrupted over all the ink zones even though it has a thickness that is set to be different from one zone to another, the rubbing or distributing work is lessened, so that in comparison with conventional vibrator-type inking units of sheet-fed printing presses, the inking unit 8 can include fewer friction rollers 12 and 13 and associated traversing gears. Because of this type of structurally simplified construction of the inking unit 8, economies in terms of both production cost and material can be attained.

A further advantage of the inking unit 8 is that it heats up less in printing operation, so that the rheological properties of the printing ink in the printing process can be better controlled, cooling of the ink duct roller is unnecessary, and hardly any component deformation caused by temperature occurs. This is achieved by providing that no metering element 25 forming a metering gap 29 rests either indirectly over the ink duct film 26 or directly on the ink duct roller 10. Because friction thus occurs in the metering gap 29, caused solely by the ink pumped out of the ink duct, and this friction is much less than the friction of one solid body on another solid body, the ink duct roller 10 can have a smaller, lower-power electric motor assigned thereto for rotatively driving the ink duct roller 10, and such a motor contributes only slightly to heating of the inking unit 8.

It is also worth mentioning that the metering quantity setting range of the inking unit 8 is greater than in conventional vibrator inking units. The minimum ink quantity, representing a lower limit for the metering quantity setting range, is zero, and the maximum ink quantity, representing an upper limit of the metering range, can be greater than 4 grams per square meter.

We claim:

1. In a printing machine, an inking unit formed as a vibrator-less continuous-type inking unit, comprising:

an ink duct with an ink metering system subdivided into ink zones having widths, said ink metering system having metering elements, said widths of said ink zones being determined by said metering elements;

an ink duct roller, said ink duct roller and said ink metering system defining a settable metering gap therebetween;

a film roller, said ink duct roller and said film roller together defining a film nip therebetween, said film nip having a width remaining constant during printing; and an ink duct film inserted between said ink duct roller and said ink metering system, said ink duct film within each of said ink zones in a region of said settable metering gap being held out of contact with said ink duct roller during printing;

said ink duct film and said ink duct roller defining a pressure-free gap therebetween over a full width of each ink zone not requiring ink.

2. The inking unit according to claim 1, wherein said ink duct film rests on a base of said ink duct, and said base covers said ink metering system.

3. The inking unit according to claim 1, wherein a central angle of said ink duct roller, said angle being defined by said film nip and by said metering gap between said ink duct film and said ink duct rolle,r is of 70° to 110°.

4. The inking unit according to claim 1, wherein a central angle of said film roller, said angle being defined by said film nip and by a printing nip between said film roller and an ink roller resting thereon, is of 70° to 110°.

5. The inking unit according to claim 1, wherein said ink metering system is supported on a bearing bushing of said ink duct roller via an adjusting device.

6. The inking unit according to claim 5, wherein said adjusting device rests on a part of said bearing bushing protruding from a frame.

7. The inking unit according to claim 5, where in said adjusting device comprises a threaded pin and a lock nut.

8. A printing machine having an inking unit formed as a vibrator-less continuous-type inking unit, comprising:

an ink duct with an ink metering system subdivided into ink zones having widths, said ink metering system having metering elements, said widths of said ink zones being determined by said metering elements;

an ink duct roller, said ink duct roller and said ink metering system defining a settable metering gap therebetween;

a film roller, said ink duct roller and said film roller together defining a film nip therebetween, said film nip having a width remaining constant during printing; and an ink duct film inserted between said ink duct roller and said ink metering system, said ink duct film within each of said ink zones in a region of said settable metering gap being held out of contact with said ink duct roller during printing;

said ink duct film and said ink duct roller defining a pressure-free gap therebetween over a full width of each ink zone not requiring ink.

9. A sheet-fed printing machine having an inking unit formed as a vibrator-less continuous-type inking unit, comprising:

an ink duct with an ink metering system subdivided into ink zones having widths, said ink metering system having metering elements, said widths of said ink zones being determined by said metering elements;

an ink duct roller, said ink duct roller and said ink metering system defining a settable metering gap therebetween;

a film roller, said ink duct roller and said film roller together defining a film nip therebetween, said film nip having a width remaining constant during printing; and an ink duct film inserted between said ink duct roller and said ink metering system, said ink duct film within each of said ink zones in a region of said settable metering gap being held out of contact with said ink duct roller during printing;

said ink duct film and said ink duct roller defining a pressure-free gap therebetween over a full width of each ink zone not requiring ink.

10. In a printing machine, an inking unit formed as a vibrator-less continuous-type inking unit, comprising:

an ink duct with an ink metering system subdivided into ink zones;

an ink duct roller, said ink duct roller and said ink metering system defining a settable metering gap therebetween;

a film roller, said ink duct roller and said film roller together defining a film nip therebetween, said film nip having a width remaining constant during printing; and an ink duct film inserted between said ink duct roller and said ink metering system, said ink duct film within each of said ink zones in a region of said settable metering gap being held out of contact with said ink duct roller during printing;

said ink duct roller having a central angle, defined by said film nip and by said metering gap between said ink duct film and said ink duct roller, being of 70° to 110°.

11. In a printing machine, an inking unit formed as a vibrator-less continuous-type inking unit, comprising:

an ink duct with an ink metering system subdivided into ink zones;

an ink duct roller, said ink duct roller and said ink metering system defining a settable metering gap therebetween;

a film roller, said ink duct roller and said film roller together defining a film nip therebetween, said film nip having a width remaining constant during printing; and an ink duct film inserted between said ink duct roller and said ink metering system, said ink duct film within each of said ink zones in a region of said settable metering gap being held out of contact with said ink duct roller during printing;

said film roller having a central angle, defined by said film nip and by a printing nip between said film roller and an ink roller resting thereon, being of 70° to 110°.

12. In a printing machine having a frame, an inking unit formed as a vibrator-less continuous-type inking unit, comprising:

an ink duct with an ink metering system subdivided into ink zones;

an ink duct roller with a bearing bushing, said ink duct roller and said ink metering system defining a settable metering gap therebetween;

a film roller, said ink duct roller and said film roller together defining a film nip therebetween, said film nip having a width remaining constant during printing;

an ink duct film inserted between said ink duct roller and said ink metering system, said ink duct film within each of said ink zones in a region of said settable metering gap being held out of contact with said ink duct roller during printing; and an adjusting device resting on a part of said bearing bushing protruding from the frame and supporting said metering system on said bearing bushing of said ink duct roller.

* * * * *